US005330076A

United States Patent [19]

Tsuruta

[11] Patent Number: 5,330,076

[45] Date of Patent: Jul. 19, 1994

[54] FILLING CONNECTOR AND DISCHARGEABLE BAG

[75] Inventor: Orihiro Tsuruta, Gunma, Japan

[73] Assignee: Orihiro Co., Ltd., Tomioka, Japan

[21] Appl. No.: 52,829

[22] Filed: Apr. 27, 1993

[30] Foreign Application Priority Data

Oct. 5, 1992 [JP] Japan ..... 4-266311

[51] Int. Cl.[5] ..... B67B 7/24

[52] U.S. Cl. ..... 222/83

[58] Field of Search ..... 222/80–89

[56] References Cited

U.S. PATENT DOCUMENTS

| | | | |
|---|---|---|---|
| 3,339,812 | 9/1967 | Meissner | 222/83 X |
| 4,475,670 | 10/1984 | Rutter | 222/83 |
| 4,493,438 | 1/1985 | Rutter | 222/83 |
| 4,723,689 | 2/1988 | Vallos et al. | 222/83 X |
| 5,005,732 | 4/1991 | Penn | 222/81 X |
| 5,016,757 | 5/1991 | Chatovrel | 222/83.5 X |
| 5,020,690 | 6/1991 | Kishikawa et al. | 222/81 X |
| 5,127,550 | 7/1992 | Knorr | 222/83 |
| 5,141,133 | 8/1992 | Ninomiya et al. | 222/81 |
| 5,141,134 | 8/1992 | Machado | 222/83.5 |
| 5,147,070 | 9/1992 | Iwamoto | 222/81 |

FOREIGN PATENT DOCUMENTS

| | | | |
|---|---|---|---|
| 76012/87 | 2/1988 | Australia . | |
| 19873/87 | 1/1989 | Australia . | |
| 6062027 | 9/1983 | Japan | 222/83 |

*Primary Examiner*—Andres Kashnikow
*Assistant Examiner*—Kenneth DeRosa
*Attorney, Agent, or Firm*—Oblon, Spivak, McClelland, Maier & Neustadt

[57] ABSTRACT

A filling connector of the present invention includes a tubular first connection element having a hollow portion and a tubular second connection element supported for sliding movement on an inner circumferential face of the first connection element and having teeth formed at one end thereof. The first and second connection elements are provided with a holding mechanism for holding the second connection element in a first position in which the second connection element is accommodated within the first connection element and a second position in which one end of the second connection element projects from the first connection element.

14 Claims, 8 Drawing Sheets

FILLING CONNECTOR AND DISCHARGEABLE BAG

BACKGROUND OF THE INVENTION

1. Field of the Invention

This invention relates to a filling connector for discharging the contents of a bag filled with a material in the form of liquid or paste.

2. Description of the Related Art

In recent years, various goods are sold in dischargeable containers for accommodating the goods in order to reduce waste of the packed material.

Goods of the type mentioned are principally food in the form of liquid or paste such as sauce or dressing or cleaning material in the form of liquid, and these goods are handled particularly by restaurants or hospitals where the goods are consumed in large amounts. Recently however, for the same above-described object, various materials for home use are also sold in dischargeable containers, and the number of kinds of materials thus sold is increasing.

Most conventional dischargeable materials are enclosed in flexible bags, and in order to discharge the material, the bag is partially cut and is squeezed to force out the packed material enclosed therein through the cut opening.

Some conventional dischargeable materials for business use which are consumed in large amounts employ a bag having a cappable plug member welded to the outer side thereof. Upon discharging the material for the first time, the bag is broken at a portion thereof within the plug member. When packed material remains in the bag, the plug member may be capped so as to prevent leakage of the packed material remaining in the bag or admission of dust or foreign matter into the bag.

However, dischargeable bags conventionally used merely enclose the packed material therein. A container which is to be filled with a packed material is naturally formed as a container for accommodating a material in the form of liquid or paste, and in most cases, the entrance of such a container through which a material in a dischargeable bag is to be poured is generally formed of a small size compared with the profile (capacity) of the container. Accordingly, there is a problem that, when the dischargeable bag is partly broken to allow for discharge of the packed material, the packed material is liable to spill around the container.

There is another problem in that, for a transfer operation, it is necessary to have ready a blade for cutting the bag in addition to the bag in which the packed material is contained and the container into which it will be transferred, and the transfer operation is therefore cumbersome.

Further, when some packed material remains in the bag upon completion of a transfer operation, the cut opening of the bag must necessarily be sealed to prevent the packed material from leaking through the cut opening. However, since the bag is flexible as described above, there is a further problem in that the cut opening cannot be effectively sealed and the prevention of leakage cannot be achieved sufficiently. Where a capable plug member is provided for the bag, the last-mentioned problem is eliminated, but since the plug member projects from the bag, there is a problem in that the plug member is liable to collide, upon transportation, with a foreign object, causing damage to the plug member or the bag, and the plug member therefore becomes an obstacle when transporting the bag.

The problems described above are naturally a concern in restaurants or hospitals where material is consumed in large amounts and frequent transfer operations are required. However, with the recent tendency toward the saving of resources and the prevention of the production of waste, the problems are a matter of particular concern from the point of view that they are an obstacle to the popularization of packed materials for home use.

SUMMARY OF THE INVENTION

It is an object of the present invention to provide a filling connector and a dischargeable bag wherein a transfer operation can be performed by a simple operation using only the bag and a container without allowing the packed material to spill outside the container, and, when packed material remains in the bag upon completion of the operation, a countermeasure for prevention of leakage of the packed material can be performed readily and with certainty.

In order to attain the object described above, according to an aspect of the present invention, there is provided a filling connector, which comprises a tubular first connection element having a hollow portion, and a tubular second connection element having teeth formed at one end thereof and supported for sliding movement on an inner circumferential face of the first connection element, the first and second connection elements being provided with holding means for holding the second connection element in a first position in which the second connection element is accommodated in the first connection element and a second position in which one end of the second connection element projects from the first connection element.

A first hole to allow the outside to communicate with the hollow portion of the first connection element may be formed at a portion of the first connection element in the proximity of an end portion on the side from which one end of the connection element projects when the second connection element is in the second position while a second hole for allowing the first hole formed in the first connection element to communicate with. The hollow portion of the second connection element when the second connection element is in the second position is formed in the second connection element.

A step or a flange may be formed on the outer periphery of the first connection element.

According to another aspect of the present invention, there is provided a dischargeable bag which employs the filling connector wherein an end portion of the first connection element on the side on which the one end of the second connection element projects when the second connection element is in the second position is welded to an inner face of the dischargeable bag.

A screw thread may be formed on a body portion at the one end of the second connection element.

The filling connector of the present invention is enclosed, when it is used, in a bag together with the packed material. Upon enclosure and transportation of the bag, the second connection element is in the second position in which it is accommodated in the first connection element, and accordingly, no part of the filling connector or the bag will be damaged and resulting leakage of the packed material can be prevented. When the packed material is to be transferred, the operator will first press the first connection element against the inner face of the bag and then push the second connection element to force it into the second position in which the one end of the second connection element on which the teeth are formed projects from the first connection element. After the teeth formed on the one end of the second connection element break the bag by being pushed through, the packed material can be discharged from the one end of the second connection element through the hollow portions of the first and second connection elements, thereby enabling transfer of the packed material.

Where the holes are formed in the first and second connection elements, the packed material is discharged to the outside through the holes. The hole formed in the first connection element can discharge a larger amount of the packed material because it is formed in the proximity of the end portion of the first connection element at which the first connection element contacts the bag.

Where the step is formed on the outer periphery of the first connection element, the packed material can be transferred into containers having openings of various diameters. On the other hand, where the flange is formed on the outer periphery of the first connection element, the convenience in using the filling connector is improved.

Where the filling connector is welded to the inner face of the bag, upon completion of a transfer operation, the one end of the second connection element is held in a position in which it projects outside the bag, and accordingly, the packed material remaining in the bag can be prevented from leaking from the bag by simply closing one end of the second connection element projecting in this manner.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DESCRIPTION OF THE PREFERRED EMBODIMENTS

Figure 1A:
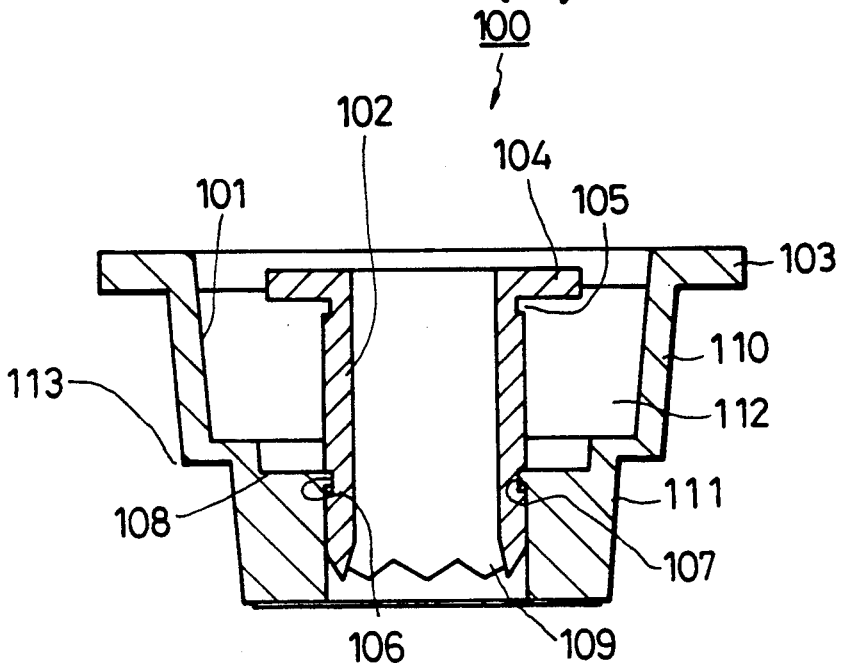
FIG. 1(*a*) is a sectional view showing the construction of a first embodiment of a filling connector of the present invention, and FIG. 1(*b*) is a bottom plan view of the filling connector.
Figure 1B:
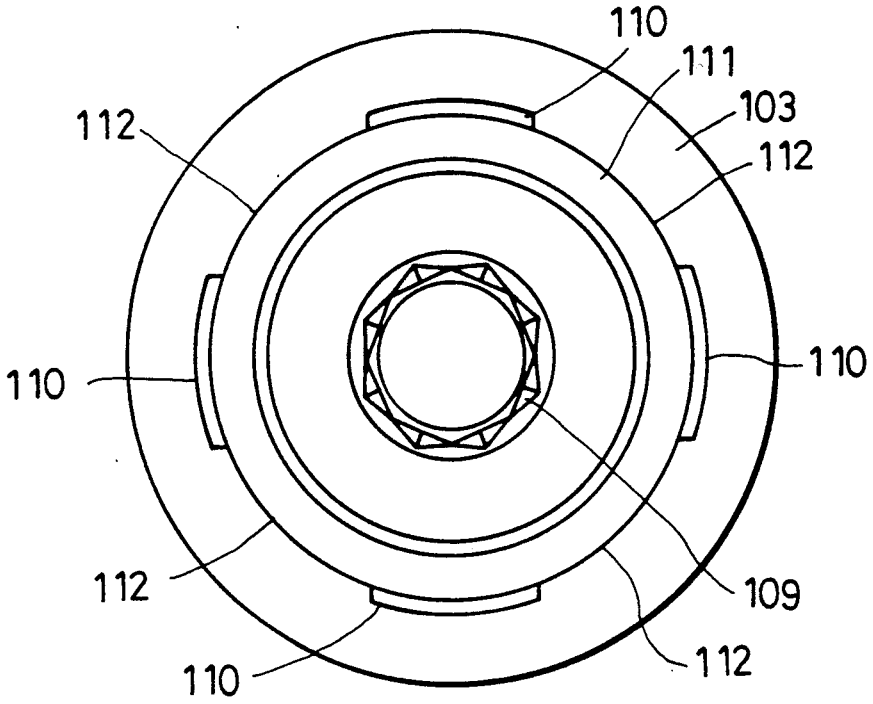

A first embodiment of a filling connector of the present invention will now be described with reference to FIGS. 1(*a*), 1(*b*) and 2. Filling connector 100 of the present embodiment is enclosed in a bag together with the packed material, and upon a transfer operation, it is used as a connector between a container and the bag. The filling connector 100 is constituted of two members including a first connection element 101 and a second connection element 102. In FIGS. 1(*a*), 1(*b*) and 2, first and second connection elements 101 and 102 are shown in their positions during transportation.

Each of the first and second connection elements 101 and 102 is formed as a member having a hollow portion and having a symmetrical rotation profile, and the second connection element 102 is held in a position (first position) in which it is accommodated in the hollow portion of first connector 101 as shown in FIGS. 1(*a*), 1(*b*) and 2.

Figure 2:
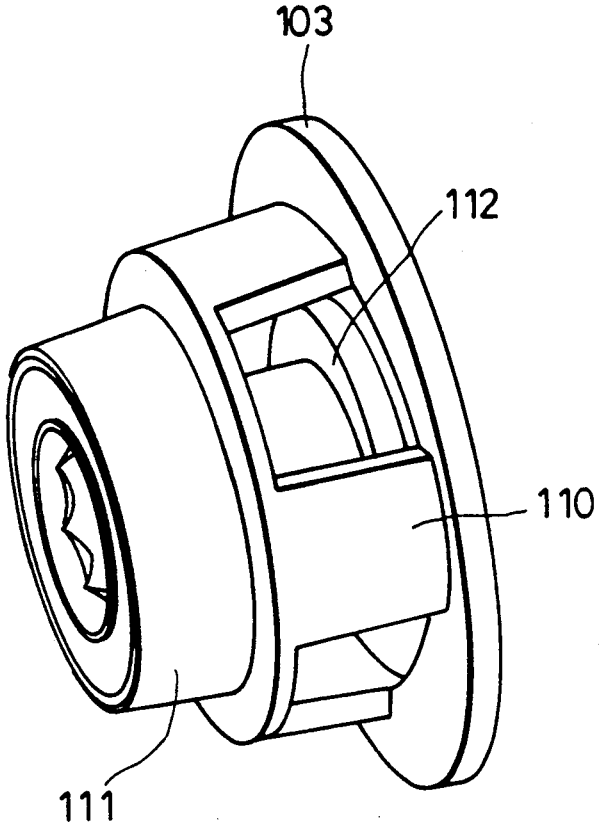
FIG. 2 is a perspective view of the filling connector shown in FIGS. 1(*a*) and 1(*b*)

The first connector 101 is formed from a resin having suitable flexibility and constituted by an insert portion 111 serving as an inlet to a container, a flange 103 having a larger diameter than the insert portion 111, and four legs 110 interconnecting the flange 103 and the insert portion 111. Openings 112 are defined between the legs 110 as seen from the bottom plan view of FIG. 1(*b*) and the perspective view of FIG. 2. The insert portion 111 is formed in such a manner that the diameter thereof gradually increases toward the flange 103 (toward the top in FIG. 1(*a*)), and is connected to the legs 110 at a stepped portion 113 formed at a portion thereof at which the diameter thereof is at a maximum. The upper face of the inner circumferential face of the stepped portion 113 serves as a holding face 108 which contacts a flange 104 formed on the second connection element 102 which will be hereinafter described. The inner circumferential face of the insert portion 111 serves as a portion into which the second connection element 102 is to be fitted for a sliding movement, and a projection 107 is integrally formed on the inner circumferential face of the insert portion 111 over the entire circumference and extends toward the axis of symmetry of the first connection element 101.

The second connection element 102 is also formed from a resin having suitable flexibility and is in the form of a cylindrical member having a flange 104 formed at an end portion (upper end portion in FIG. 1(*a*)) thereof and having serrated teeth formed at the end 109 opposite the end of the cylindrical member. A first groove 105 and a second groove 106 are provided for engaging the projection 107 formed on the first connection element 101 and together constitute holding means with the projection 107 and are formed spaced from each other over the entire periphery of the outer circumferential face of the cylindrical portion the second connection element 102. Second connection element 102 is formed with a smaller height than first connection element 101, and during transportation, as shown in FIG. 1(*a*), the projection 107 engages the second groove 106 and the second connection element 102 is accommodated within the first connection element 101.

The operation for transferring the packed material with the filling connector of the present embodiment is described below.

Figure 3:
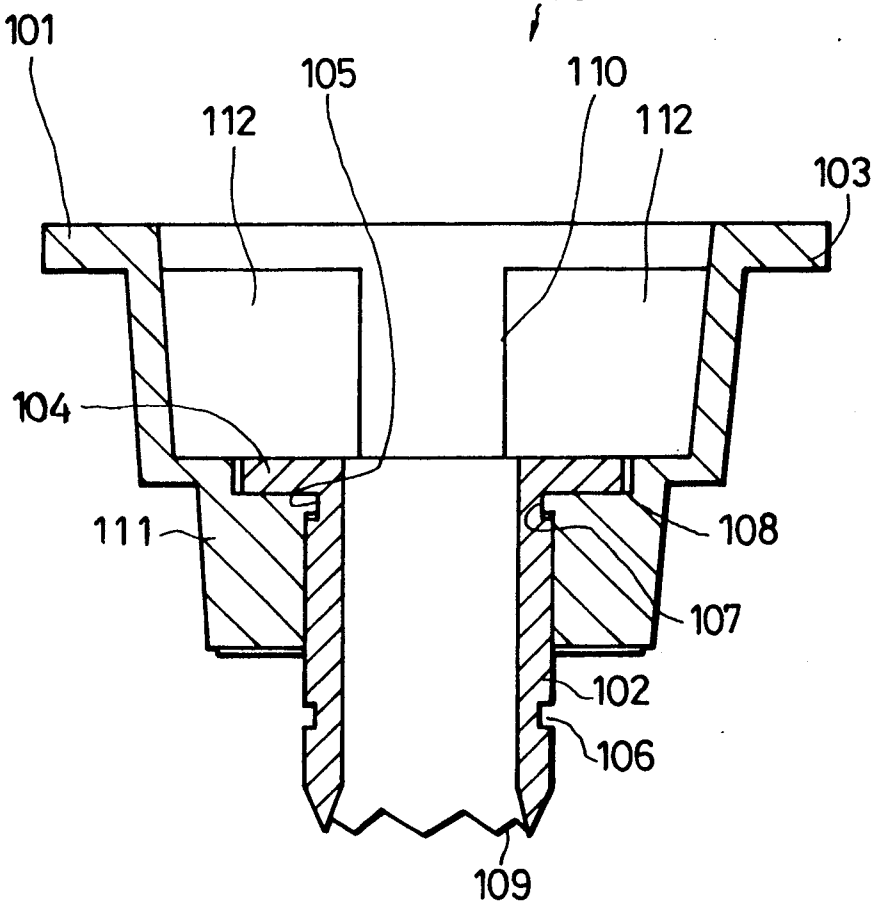
FIG. 3 is a sectional view of the filling connector shown in FIGS. 1(*a*) and 1(*b*) during a transfer operation.
Figure 4:
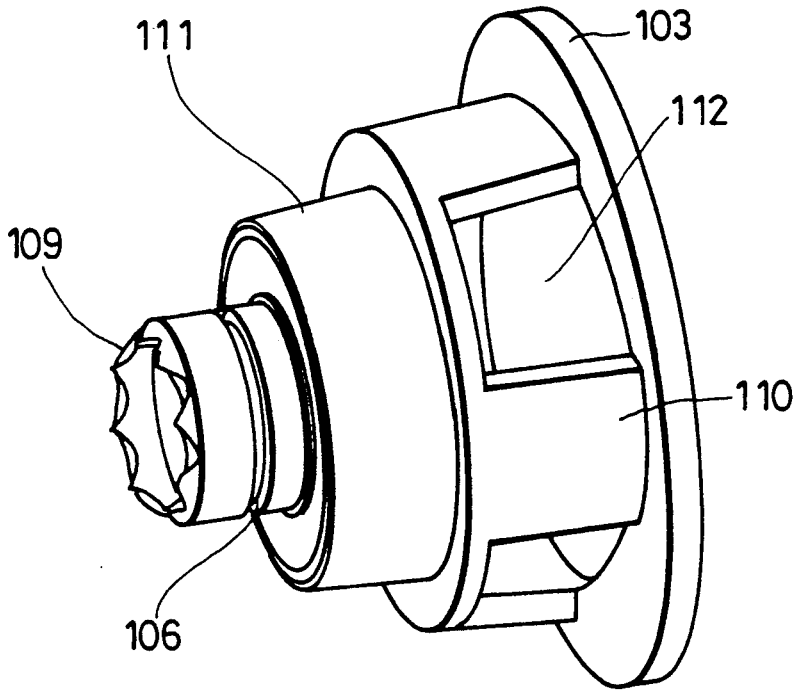
FIG. 4 is a perspective view of the filling connector shown in FIGS. 1(*a*) and 1(*b*) during a transfer operation.

FIGS. 3 and 4 show the condition of the filling connector of the present embodiment during a transfer operation.

The filling operator while holding the bag (not shown) from above, the filling connector 100 being enclosed in the bag together with the packed material, positions the insert portion 111 side (lower side in FIG. 3) of the first connector 101 against the inner face of the bag and, in this condition, pushes the second connection element 102 so that it projects against the surface of the bag. When the element is pushed, the engagement between the projection 107 and the second groove 106 shown in FIG. 1(*a*) is broken, and the end 109 of the second connection element 102 on which the serrated are formed punctures the bag and protrudes from the bag. The second connection element 102 is pushed such that it projects out of the bag until the flange 104 of the second connection element 102 abuts and is stopped by the holding face 108 of the first connection element 101. As a result, the projection 107 will be engaged with the first groove 105 as shown in FIG. 3, and the second connector 102 will thereafter be held in a position (second position) for filling in which it projects from the first connection element 101.

Figure 5:
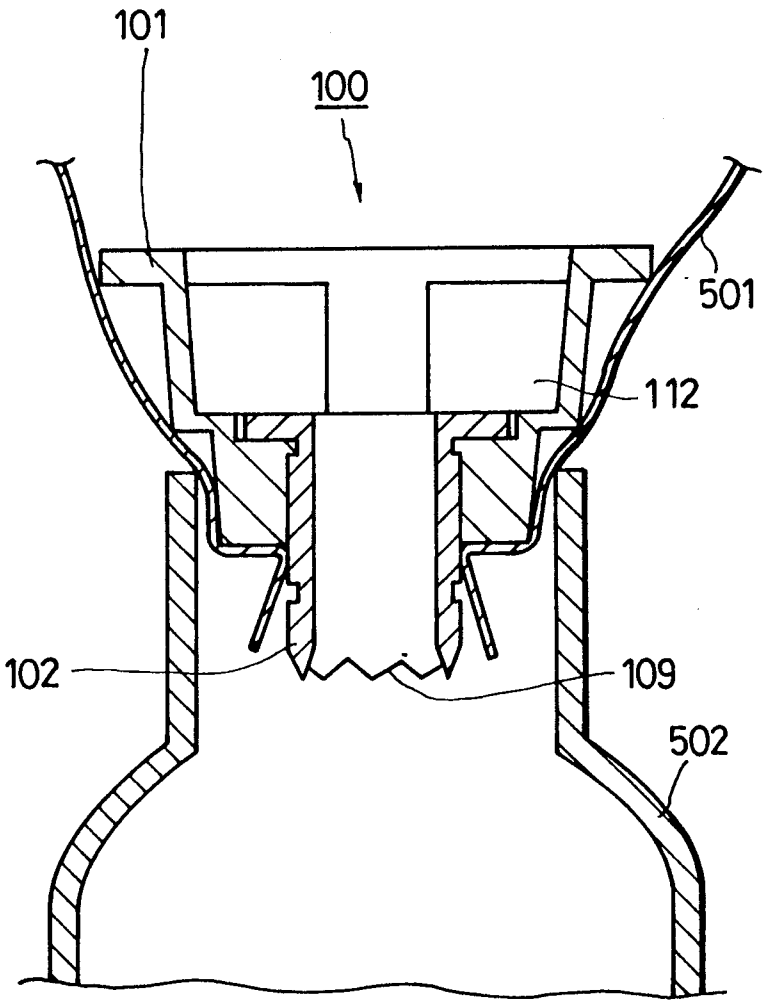
FIG. 5 is a partial sectional view showing the filling connector shown in FIGS. 1(*a*) and 1(*b*) together with a bag and a container.

FIG. 5 shows the filling connector 100 during the transfer operation described above together with the bag 501 and the container 502.

The filling operator inserts the end 109 of the filling connector 100 into the opening at the top end of a container 502 and then squeezes the bag 501. With the squeezing operation, the packed material in the bag 501 is discharged into the container 502 through the opening 112 formed in the first connection element 101 and the hollow portion of the second connector 102 to effect transfer of the packed material. In this instance, the air in the container 502 is discharged to the outside through a gap between the top end opening of the container 502 and the bag 501. In the transfer operation just described, since the outer circumferential portion of the first connection element 101 serves as a funnel, the packed material can be transferred without leakage of the material to the outside of the container 502.

In the present embodiment, if the filling connector 100 is enclosed in a bag together with the packed material, a transfer operation can be performed without using any additional implements and without allowing the packed material to leak to the outside of the container.

Figure 6:
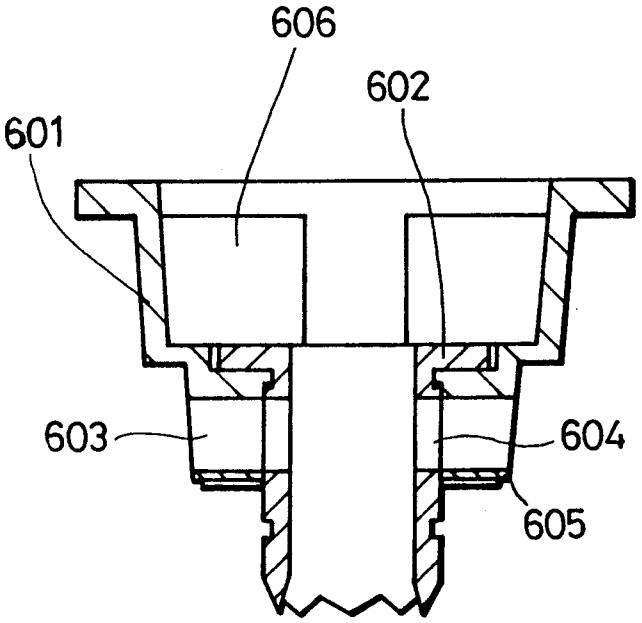
FIG. 6 is a sectional view showing the construction of a second embodiment of a filling connector of the present invention.

FIG. 6 shows the construction of a second embodiment of a filling connector of the present invention. The filling connector of the present embodiment is constructed so as to allow the packed material to be squeezed out efficiently and includes a first connection element 601 similar to the one employed in the first embodiment but which has holes 603 formed locally at suitable portions thereof, and a second connection element 602 similar to the one employed in the first embodiment but that has holes 604 formed locally at suitable portions thereof. The rest of the construction of the filling connector of the present embodiment is similar to that of the first embodiment shown in FIGS. 1(*a*) to 5, and accordingly, redundant description thereof will omitted.

Holes 603 formed in the first connection element 601 establish communication between the outside and the hollow portion of the first connection element 601 and are formed at an insert portion 605 which serves as the container side portion (lower portion in FIG. 6) during transfer operation. The holes 604 provided in the second connection element 602 are formed at locations at which they establish communication between the holes 603 formed in the first connection element 601 and the hollow portion of the second connection element 602 when the filling connector is in a filling position shown in FIG. 6 wherein the second connection element 602 projects outwardly from the bag. Consequently, the packed material in the bag can be discharged into the container not only through opening 606 formed in the first connection element 601 but also through holes 603 and 604, and accordingly, the amount of the packed material which may remain within the bag upon completion of the transfer operation is reduced and the packed material can be transferred efficiently.

Figure 7A:
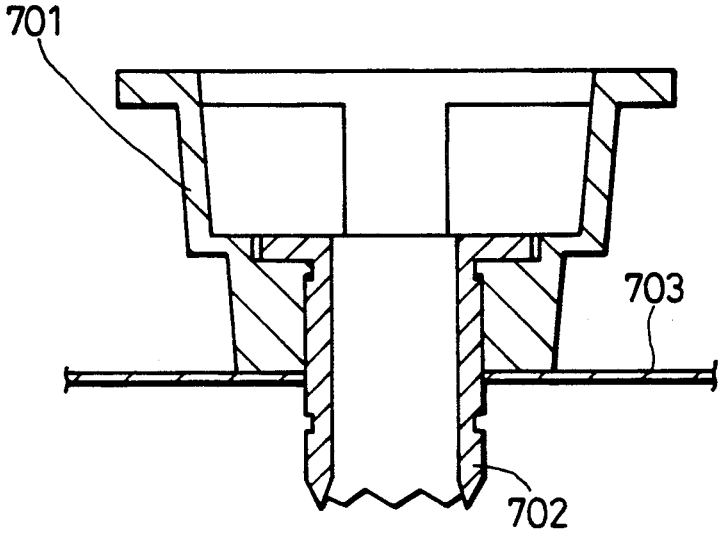
FIGS. 7(*a*) and 7(*b*) are sectional views showing the construction of a third embodiment of a filling connector of the present invention.
Figure 7B:
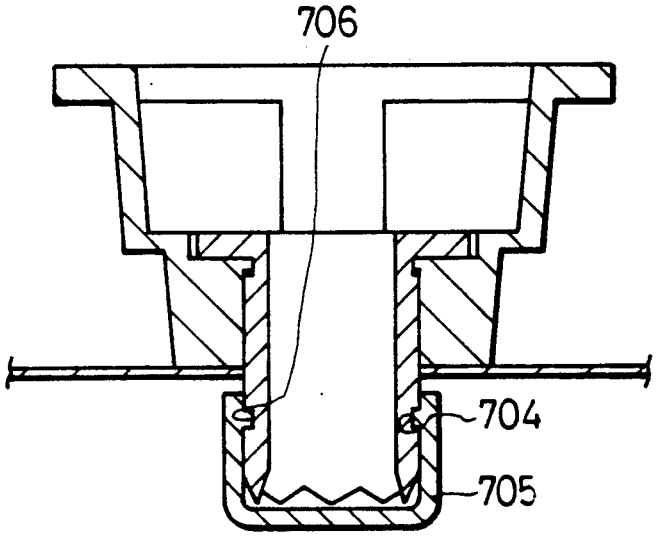

FIGS. 7(*a*) and 7(*b*) show the construction of a third embodiment of a filling connector of the present invention.

In the first and second embodiments, since the filling connector is not fixed in the bag, when the packed material remains in the bag upon completion of the transfer operation, it is necessary to prevent the packed material from leaking using a method similar to the conventional method.

Therefore, the filling connector of the present embodiment is constructed so as to improve the operability and the leakage prevention performance when packed material remains in a bag after completion of a transfer operation and includes a first connection element 701 having an end face (lower end face in FIGS. 7(*a*) and 7(*b*)) secured to the inner face of the bag 703 by welding. The rest of the construction of the filling connector is similar to that of the first embodiment shown in FIGS. 1(*a*) to 5, and accordingly, redundant description thereof is omitted.

Since the filling connector has the construction described above, the end portion of the second connector 702 is held in a position wherein it projects outside bag 703 when transfer operation is completed. Since the end portion projecting in this manner can be readily capped, leakage prevention performance can be improved. More particularly, the end portion can be capped with a cap member 705 provided with a projection 704 which engages with a second groove 706 formed on the second connector 702 as shown in the example shown in FIG. 7(*b*). Capping of the end portion can thus be performed securely by using a cap member 705 provided with a projection 704.

Figure 8:
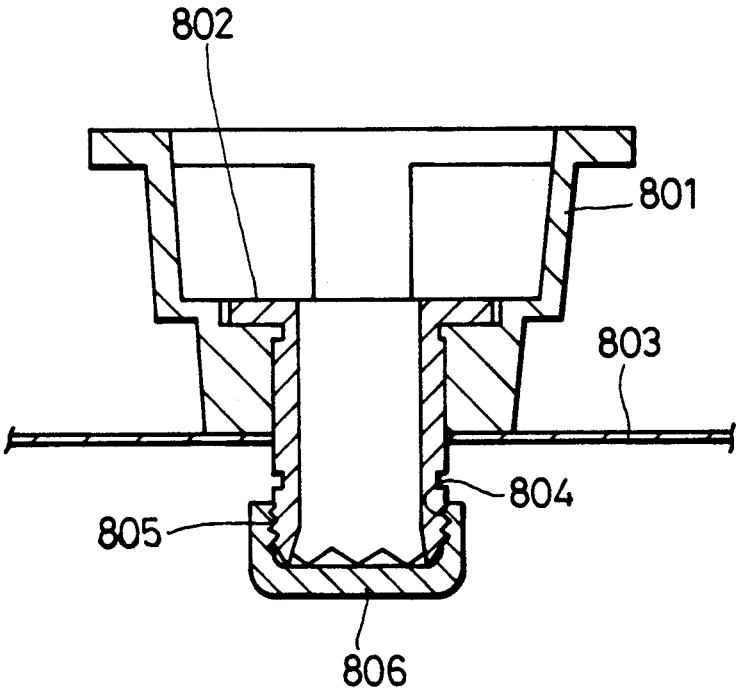
FIG. 8 is a sectional view showing the construction of a fourth embodiment of a filling connector of the present invention.

FIG. 8 shows the construction of a fourth embodiment of a filling connector of the present invention. The filling connector of the present embodiment includes a first connection element 801 having an end face (lower end face in FIG. 8) welded to the inner 25 face of the bag 803 in a manner similar to the third embodiment shown in FIGS. 7(*a*) and 7(*b*), and a second connection element 802 having a screw thread 804 formed at a body portion at an end portion thereof. The rest of the construction of the filling connector is similar to that of the first embodiment shown in FIGS. 1(*a*) to 5, and accordingly, redundant description thereof will be omitted.

In the present embodiment, since a screw thread 804 is formed in the body portion at the end portion of the second connection element 802 which projects outside bag 803 upon completion of a transfer operation, it is possible to screw a cap member 806, which has a screw thread 805 formed on the inner circumferential face thereof as shown in FIG. 8, with a screw thread 804 to cap the body portion at the end portion of the second connection element 802. Consequently, the leakage prevention performance can be further improved.

It is to be noted that the construction for improvement of the leakage prevention performance provided in the third and fourth embodiments of the present invention may naturally be combined with the construction for squeezing out packed material efficiently provided in the second embodiment of the present invention.

Further, the bag provided in the third and fourth embodiments of the present invention can be used not only as a dischargeable bag but also as a container for, for example, fresh cream or ketchup, since a countermeasure for prevention of leakage can be achieved readily and with certainty. When the bag is used for these applications, the shape of the end portion of the second connection element thereof may be modified in accordance with the contents thereof.

When the bag is also used as a container as described just above, the filling connector itself may have a capping capacity. The construction to achieve the action may be, for example, a construction wherein the holes are formed locally in the first and second connection elements so that the holes formed in the first connection element may be placed in or out of communication with the outside by the second connection element or provision of an additional valve mechanism, and naturally, any of the means may be employed.

Further, while in the embodiments described above a step is described that is formed on the first connection element, it is provided in order to allow the filling connector to cope with containers of various diameters and to assure convenience in use. For the purpose of adapting to various containers, a plurality of steps may be formed, or in order to improve the convenience in use, a flange may be formed at an intermediate portion of the outer periphery of the first connection element.

Since one of the filling connectors of the present invention is constituted from a first connection element and a second connection element which are provided with a holding means for holding the second connection element in a first position or in a second position, there is an effect in that a transfer operation of packed material can be performed readily without allowing the packed material to be spilt. Further, since the filling connector which provides the effect is enclosed in a bag together with the packed material during transportation, even if it is transported in the same was as an ordinary bag, the filling connector will not present an obstacle and neither the filling connector nor the bag will be damaged.

Further, since one of the filling connectors holes are formed in the first and second connection elements, there is an effect, in addition to the effects described above, that a larger amount of packed material can be discharged from a bag and the packed material can be transferred efficiently.

Furthermore, because one of the filling connectors a step is formed on the outer periphery of the first connection element, there is an effect, in addition to the effects described above, that the filling connector can cope with containers of various diameters.

In addition, due to the fact that in one of the filling connectors a flange is formed on the outer periphery of the first connection element, there is an effect, in addition to the effects described above, that the convenience in use can be improved.

Meanwhile, in view of the fact that in one of the dischargeable bags of the present invention the filling connector described above is welded to the inner face, since the second connection element is held in a position wherein it projects outwardly from the bag upon completion of a transfer operation, there is an effect that capping can be performed readily, and that a countermeasure for prevention of leakage when the packed material remains in the bag can be achieved simply and that the leakage prevention performance can be improved.

Further, since in one of the dischargeable bags wherein a screw thread is formed in a body portion at an end portion of the second connection element, capping of the end portion of the second connection element can be performed with certainty by using a cap member on which a screw thread for engaging with the screw thread of the second connection element is formed, and accordingly, there is an effect that the leakage prevention performance can be further improved.

Obviously, numerous modifications and variations of the present invention are possible in light of the above teachings. It is therefore to be understood that within the scope of the appended claims, the invention may be practiced otherwise than as specifically described herein.

WHAT IS CLAIMED IS:

1. A filling connector, comprising:

a tubular first connecting element having a hollow portion; and a tubular second connection element having teeth formed at one end thereof and supported for sliding movement on an inner circumferential face of said first connection element wherein said first and second connection elements are located within a bag filled with a material and said first connection element is secured to an inner face of said bag;

said first and second connection elements being provided with a holding mechanism for holding said second connection element in a first position in which said second connection element is accommodated within said first connection element and in a second position in which the one end of said second connection element projects from said first connection element.

2. A filling connector as claimed in claim 1, wherein a first hole for allowing an area outside the first connection element and said hollow portion of said first connection element to communicate with each other is formed at a portion of said first connection element in proximity with an end portion of said second connection element when said second connection element is in the second position, and a second hole is formed in said second connection element for allowing said first hole formed in said first connection element to communicate with said second hole of said second connection element when said second connection element is in the second position.

3. A filling connector as claimed in claim 1, wherein a step is formed on an outer periphery of said first connection element.

4. A filling connector as claimed in claim 2, wherein a step is formed on an outer periphery of said first connection element.

5. A filling connector as claimed in claim 1, wherein a flange is formed on an outer periphery of said first connection element.

6. A filling connector as claimed in claim 2, wherein a flange is formed on an outer periphery of said first connection element.

7. A dischargeable bag which employs a filling connector as claimed in claim 1, wherein an end portion of said first connection element on the side on which one end of said second connection element projects when said second connection element is in the second position is welded to an inner face of said dischargeable bag.

8. A dischargeable bag which employs a filling connector as claimed in claim 2, wherein an end portion of said first connection element on the side on which one end of said second connection element projects when said second connection element is in the second position is connected to said inner face of said dischargeable bag.

9. A dischargeable bag which employs a filling connector as claimed in claim 3, wherein an end portion of said first connection element on the side on which one end of said second connection element projects when said second connection element is in the second position is connected to said inner face of said dischargeable bag.

10. A dischargeable bag which employs a filling connector as claimed in claim 4, wherein an end portion of said first connection element on the side on which one end of said second connection element projects when said second connection element is in the second position is connected to said inner face of said dischargeable bag.

11. A dischargeable bag as claimed in claim 7, wherein a screw thread is formed on a body portion at the projecting one end of said second connection element.

12. A dischargeable bag as claimed in claim 8, wherein a screw thread is formed on a body portion at the projecting one end of said second connection element.

13. A dischargeable bag as claimed in claim 9, wherein a screw thread is formed on a body portion at the projecting one end of said second connection element.

14. A dischargeable bag as claimed in claim 10, wherein a screw thread is formed on a body portion at the projecting one end of said second connection element.

* * * * *